US009422029B1

(12) United States Patent
Niemier et al.

(10) Patent No.: US 9,422,029 B1
(45) Date of Patent: Aug. 23, 2016

(54) FOLDING WATERCRAFT

(71) Applicant: Timothy A. Niemier, Bellingham, WA (US)

(72) Inventors: Timothy A. Niemier, Bellingham, WA (US); Thomas Bernard Eckert, Rancho Cucamonga, CA (US)

( * ) Notice: Subject to any disclaimer, the term of this patent is extended or adjusted under 35 U.S.C. 154(b) by 28 days.

(21) Appl. No.: 13/922,200

(22) Filed: Jun. 19, 2013

Related U.S. Application Data

(63) Continuation of application No. 13/156,331, filed on Jun. 8, 2011, now abandoned.

(60) Provisional application No. 61/352,760, filed on Jun. 8, 2010.

(51) Int. Cl.

| | |
|---|---|
| ***B63B 7/00*** | (2006.01) |
| ***B63B 7/04*** | (2006.01) |
| ***B63B 35/71*** | (2006.01) |
| ***B63B 35/79*** | (2006.01) |

(52) U.S. Cl.
CPC . *B63B 7/00* (2013.01); *B63B 7/04* (2013.01); *B63B 35/71* (2013.01); *B63B 35/7916* (2013.01)

(58) Field of Classification Search
CPC ..... B63B 7/04; B63B 35/71; B63B 3/08
USPC ..... 114/352, 353, 354, 347
See application file for complete search history.

(56) References Cited

U.S. PATENT DOCUMENTS

| | | | | |
|---|---|---|---|---|
| 1,337,781 | A | 4/1920 | Lowdermilk | |
| 1,449,222 | A | 3/1923 | Goethel | |
| 2,666,933 | A | 1/1954 | Engensperger | |
| 2,977,607 | A | 4/1961 | Roblee | |
| 4,057,865 | A | 11/1977 | Trautwein | |
| 4,366,769 | A | 1/1983 | Lingeman | |
| 5,711,692 | A | 1/1998 | Pope | |
| 6,615,762 | B1 | 9/2003 | Scott | |
| 7,347,755 | B1 | 3/2008 | Katzfey | |
| 7,395,773 | B1 * | 7/2008 | Finefield | 114/352 |

(Continued)

FOREIGN PATENT DOCUMENTS

| | | |
|---|---|---|
| AU | 2004100379 | 6/2004 |
| JP | 63265795 | 11/1988 |

OTHER PUBLICATIONS

Cobra Kayaks, "Cobra T/A Traveler", Web site http://web.archive.org/web/20000620031437/http://www.cobrakayaks.com/traveler.htm, Jun. 22, 2000, 4 pages.

(Continued)

*Primary Examiner* — Lars A Olson
(74) *Attorney, Agent, or Firm* — Michael R. Schacht; Schacht Law Office, Inc.

(57) ABSTRACT

A watercraft comprising a bow section, a center section, and a stern section, and a securing system comprising at least one strap assembly and at least one buckle assembly. The at least one buckle assembly is configured to engage the at least one strap assembly selectively to arrange the watercraft in a folded configuration and a use configuration. In the folded configuration, a bow deck surface and a stern deck surface overlap the center deck surface. In the use configuration, the bow deck surface, the center deck surface, and the stern deck surface are arranged to define a cockpit of the watercraft, and a bow hull surface, a center hull surface, and a stern hull surface are arranged to define a hull of the watercraft.

15 Claims, 18 Drawing Sheets

(56) References Cited

U.S. PATENT DOCUMENTS

| | | | | |
|---|---|---|---|---|
| 2008/0121166 | A1 | 5/2008 | Yaron et al. | |
| 2008/0246236 | A1 | 10/2008 | Lombano et al. | |
| 2009/0165695 | A1 | 7/2009 | Fritsch | |
| 2010/0024709 | A1 * | 2/2010 | Griffin | 114/352 |

OTHER PUBLICATIONS

Easy Rider Kayaks, "Eskimo 15 and 17 CRX Take-A-Part—Singes, and Eskimo 22-6 CRX 2-piece & 4-Piece Take-A-Part—Doubles" Web site http://web.archive.org/web/20050814233158/http://www.easyriderkayaks.com/take-a-part_kayaks.htm, Aug. 14, 2005, 1 page.

Point 65 N—Kayaks From Sweden, "Tequila!" modular kayak, Web site http://www.point65.com/default.asp?page=kayaks&cat=6&kayak=47, 2009, 3 pages.

BIC Sport, "Nomad HP3" convertible inflatable kayak, Web site http://web.archive.org/web/20110716011630/http:www.bicsport.com/, 2011, 3 pages.

Nicholas Notara, "Collapsible Carbon Fiber Surfboard" Website http://www.gizmag.com/collapsible-carbon-fiber-surfboard-concept/9404, 2008, 3 pages.

* cited by examiner

FOLDING WATERCRAFT

RELATED APPLICATIONS

This application, U.S. patent application Ser. No. 13/922,200 filed Jun. 19, 2013 is a continuation of U.S. patent application Ser. No. 13/156,331 filed Jun. 8, 2011, now abandoned.

U.S. patent application Ser. No. 13/156,331 claims priority benefit of U.S. Provisional Patent Application Ser. No. 61/352,760 filed Jun. 8, 2010.

The contents of all related applications identified above are incorporated herein by reference.

TECHNICAL FIELD

This application relates to small watercraft such as kayaks, canoes, row boats, sail boats, and paddle boards and, more particularly, to small watercraft that fold for ease of storage and/or transportation.

BACKGROUND

The present invention relates to small water craft such as kayaks, canoes, row boats, sail boats, and paddle boards that may be folded to obtain a smaller form factor to facilitate storage and/or transportation of the kayak. The present invention is of particular significance when applied to kayaks and paddle boards, and examples of the application of the principles of the present invention will be described herein in the context of kayaks and paddle boards. The principles of the present invention are, however, more generally applicable to other types of small watercraft such as canoes, row boats, and sail boats. The scope of the present invention should thus be determined with respect to the claims appended hereto and not the following description of several examples of the invention.

Conventional foldable kayaks have not seen a large degree of commercial success because such kayaks have typically lacked the stability, reliability, ease of use and other desirable characteristics of a traditional, one-piece kayak. Previous foldable kayaks have many shortfalls that prevented widespread adoption of folding kayaks.

SUMMARY

The present invention may be embodied as a foldable watercraft comprising a bow section, a center section, a stern section, and a securing system. The bow section defines a bow engaging surface, a bow hull surface, and a bow deck surface. The center section defines a first center engaging surface, a second center engaging surface, a center hull surface, and a center deck surface. The stern section defines a stern engaging surface, a stern hull surface, and a stern deck surface. The securing system comprises at least one strap assembly and at least one buckle assembly. The at least one buckle assembly is configured to engage the at least one strap assembly selectively to arrange the watercraft in a folded configuration and a use configuration. In the folded configuration, the bow deck surface and the stern deck surface overlap the center deck surface. In the use configuration, the bow deck surface, center deck surface, and stern deck surface are arranged to define a cockpit of the watercraft, and the bow hull surface, center hull surface, and stern hull surface are arranged to define a hull of the watercraft. In this context, the center section may define at least one cavity adapted to receive a portion of at least one of the bow and stern sections when the watercraft is in the folded configuration. The center section may further define at least one cavity adapted to receive portions of the bow and stern sections when the watercraft is in the folded configuration. At least one cavity may be formed in at least one of the bow section and the stern section to accommodate a portion of one of the bow section and the stern section when the watercraft is in the folded configuration. At least one of the bow section and the stern section may be angled to accommodate a portion of the other of the bow section and the stern section when the watercraft is in the folded configuration.

The present invention may also be embodied as a method of forming watercraft comprising the following steps. A bow section defining a bow engaging surface, a bow hull surface, and a bow deck surface is provided. A center section defining a first center engaging surface, a second center engaging surface, a center hull surface, and a center deck surface is provided. A stern section defining a stern engaging surface, a stern hull surface, and a stern deck surface is provided. At least one strap assembly and at least one buckle assembly are provided. The at least one buckle assembly is engaged with the at least one strap assembly selectively to arrange the watercraft in a folded configuration and a use configuration. In the folded configuration, the bow deck surface and the stern deck surface overlap the center deck surface. In the use configuration, the bow deck surface, center deck surface, and stern deck surface are arranged to define a cockpit of the watercraft, and the bow hull surface, center hull surface, and stern hull surface are arranged to define a hull of the watercraft.

The present invention may also be embodied as a foldable paddle board comprising a bow section, a center section, a stern section, and a securing system. The bow section defines a bow engaging surface, a bow hull surface, and a bow deck surface. The center section defines a first center engaging surface, a second center engaging surface, a center hull surface, and a center deck surface. The stern section defines a stern engaging surface, a stern hull surface, and a stern deck surface. The securing system comprises a plurality of strap assemblies and a plurality of buckle assemblies. The first and second buckle assemblies are configured to engage the first and second strap assemblies selectively to arrange the watercraft in a folded configuration and a use configuration. In the folded configuration, the bow deck surface and the stern deck surface overlap the center deck surface. In the use configuration the bow deck surface, center deck surface, and stern deck surface are arranged to define a cockpit of the watercraft, and the bow hull surface, center hull surface, and stern hull surface are arranged to define a hull of the watercraft.

DETAILED DESCRIPTION

Figure 1:
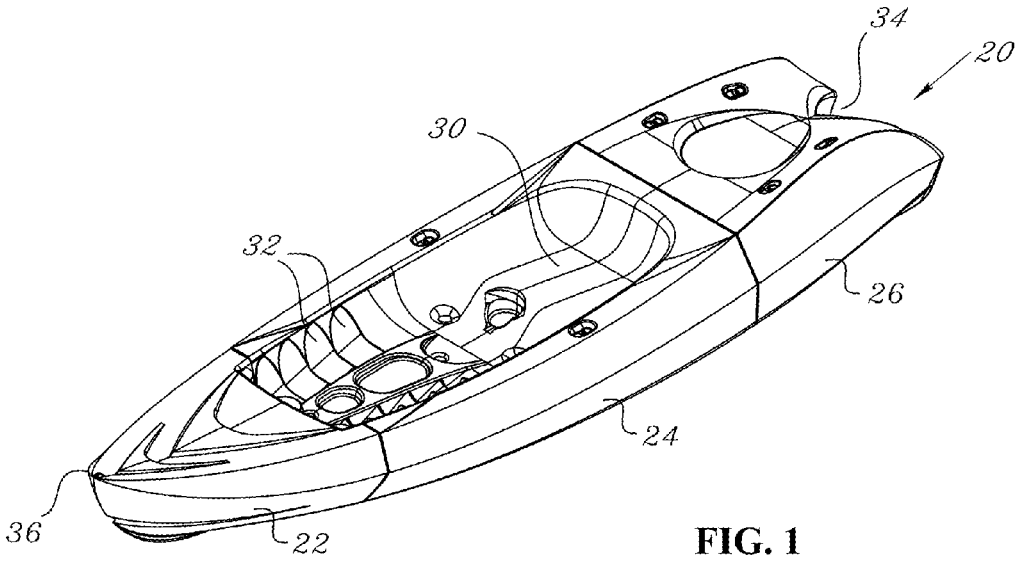
FIG. 1 illustrates a first embodiment of a kayak of the present invention.
Figure 2A:
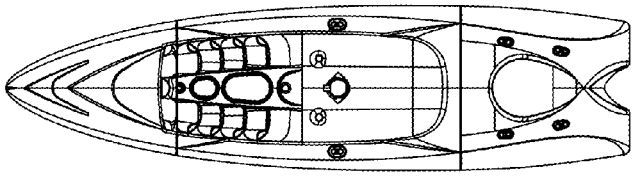
FIGS. 2A, 2B, 2C, and 2D illustrate top, side, bottom, and front views, respectively, of the first kayak embodiment depicted in FIG. 1.
Figure 2D:
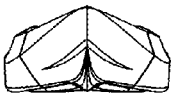
Figure 2B:
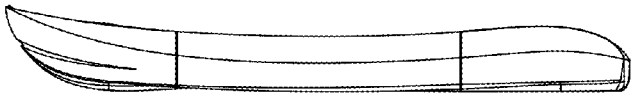
Figure 2C:
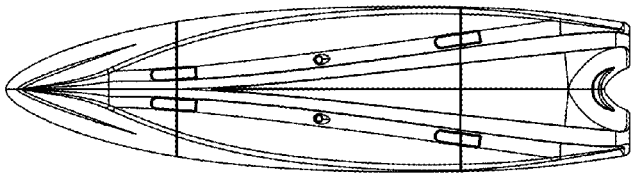

Embodiments disclosed herein describe a modular, foldable kayak. The kayak may fold into two, three, four or substantially any number of modular sections. The sections may be completely disconnectable or may be attached using various types of fastening mechanisms including hinges. The folding kayak may be produced in substantially any length including, in some cases, a length of nine feet or longer. For example, the kayak may have a length of nine feet and six inches. The foldable kayak may also be designed to fold such that it fits in a typical shopping cart or in the back seat of a car. Such a design may lead to easy transport and setup by the end-user.

In some embodiments, a folding kayak may include three sections that form two linear planes. The three sections may be attached using hinges or other forms of fasteners. In cases where hinges are used, the three hinged sections may be separated by removing one or more pins in each hinge. Additionally or alternatively, the sections may be attached or fastened to each other using other fastening means such as nuts and bolts, clasps, straps, tongues and grooves that allow for snap shut fastening, or other fastening mechanisms. The folding kayak may be manufactured using any of a variety of different techniques (or a combination of techniques) including blow molding, rotational molding, twin sheet thermoforming or other molding techniques. The structure of the kayak may be formed of plastic, fiberglass, or any other material which is moldable or capable of being shaped into a desired form.

In some embodiments, the folding kayak may fold in three sections with an integral interlocking geometry between the sections, which may increase strength. For example, one or more tongues and grooves, notches, knobs or other interlocking members may be integrated (e.g. molded) in the various sections such that when the sections are unfolded, the sections are held in place by the interlocking members. The interlocking members may be used in addition to or in place of locking features such as hinges or clasps. Additionally or alternatively, the folding kayak sections may include one or more locking features (e.g. hinges, clasps, etc.) that are added to the sections after the sections have been molded. In some cases, these locking features may be self-locking in that when the kayak's modular sections are fully unfolded, the locking features automatically lock into place.

In some embodiments, the folding kayak may include three modular sections that form two linear planes where the sections are angled slightly such that the tail and the bow of the kayak pass next to each other (i.e. they do not directly overlap when in a folded position). Thus, each end section may be folded back in a tighter, more compact position because the tail and bow ends do not overlap when folded. This may allow the folded kayak to fit into much more compact locations such as in the back seat of a car or in a car's trunk. In some cases, the folded sections of the kayak may snap or otherwise lock into place once folded. The folded sections may also have latches or clasps that can be used to lock the folded sections into place.

In some cases, the folding kayak may have its own integral bulkheads. For example, each of the (three) sections may include separate bulkheads, which may create independent vessels or sections. The bow and stern sections may provide dry storage and a hatch may be positioned so items can be easily accessed by the user. Moreover, each section may be filled independently to allow for proper balance and center of gravity.

Several example folding kayaks will now be explained in regard to the following pictures and drawings.

FIG. 1 illustrates an embodiment of a kayak 20 with three sections: a bow section 22, a center section 24, and a stern section 26. The bow section 22 may be fastened to the center section 24 using any of a variety of different fastening means including hinges, clasps, tongue-and-groove connections, and/or any other type of fastening means. The fasteners allow the bow section 22 to fold backward toward the stern section 26, over the center section 24 (this will be explained further below with regard to other figures). The center section 24 includes a seat 30 for a user, footrests 32 at various distances to accommodate differently-sized passengers, as well as storage and other compartments. The stern section 26 may similarly be fastened to the center section 24 using any of the same (or different) fastening means listed above. The stern section 22 may include a notched portion 34 to allow both the bow and stern sections to be folded while overlapping each other but without interfering with each other. As will be explained in further detail below, the notch 34 is designed to accommodate a bow line 36 defined by the bow section 22.

FIGS. 2A-D illustrates the kayak 20 with top, side, bottom and front views. Various elements of the kayak may include the flat stern portion and wide hull portion, which may provide greater stability in the water. The flat stern portion may also make the kayak very difficult to turn over. Moreover, the flat (and notched) stern portion may allow the kayak to be folded in a very compact manner as the bow and stern portions can both be folded toward the center section and fold flat without interfering.

Figure 3A:
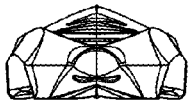
FIGS. 3A and 3B illustrate a rear elevation view and a side elevation view of the first kayak embodiment.
Figure 3B:
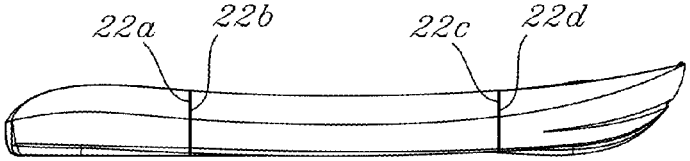

FIGS. 3A and 3B illustrate a rear view and a wire frame side view, respectively, of the example folding kayak 20. As shown in the side view of FIG. 3B, each section may have its own integral bulkhead 22*a*, 22*b*, 22*c*, and 22*d*. As such, each section may be an independent vessel. In some cases, the bulkheads may be formed in pairs with one bulkhead of each pair defining a primarily flat surface with a locator groove and the other bulkhead of each pair defining a primarily flat surface with a locator projection. Furthermore, the bow and stern sections may provide dry storage in various compartments or hatches. Still further, each section may include portions that can be independently filled to allow for proper balance and center of gravity.

Figure 4A:
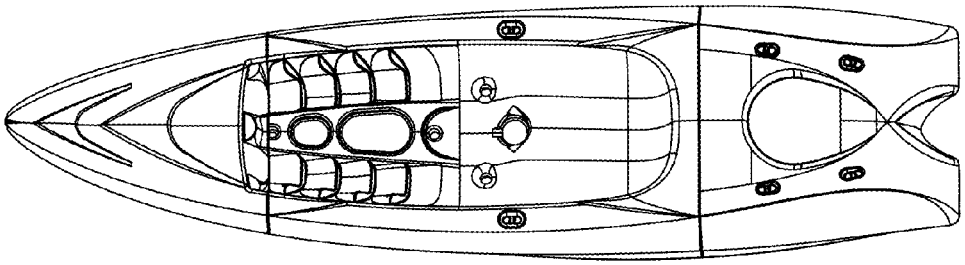
FIGS. 4A and 4B illustrates top views of the first kayak embodiment in folded and unfolded configurations.
Figure 4B:
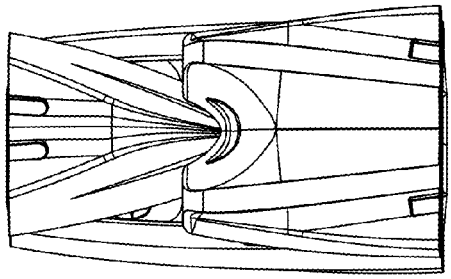
Figure 5A:
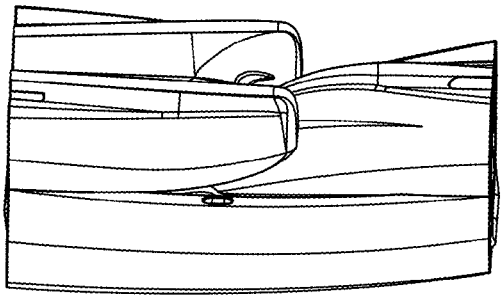
FIGS. 5A and 5B illustrate perspective views of the first kayak embodiment in folded and unfolded configurations.
Figure 5B:
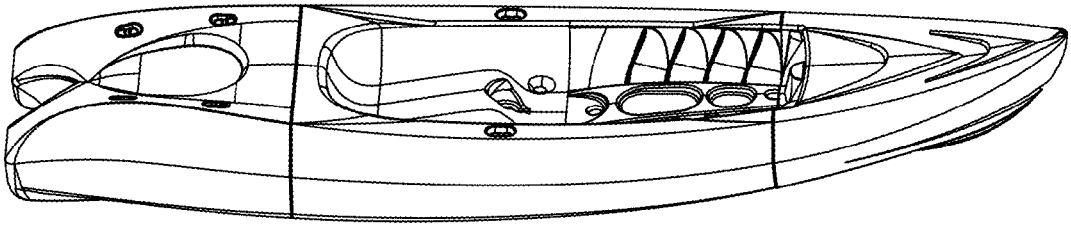
Figure 6A:
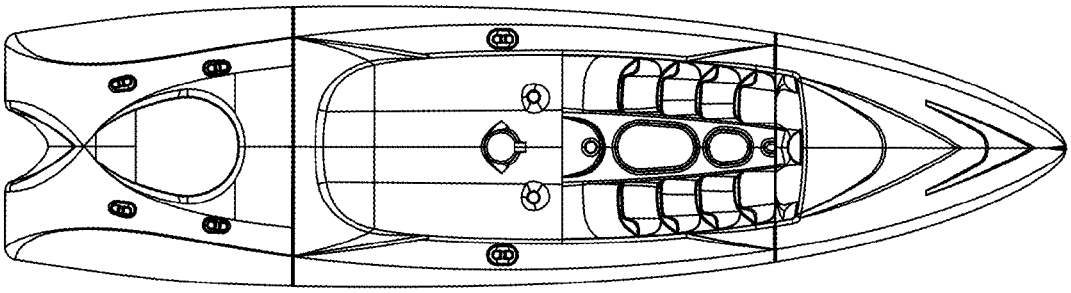
FIGS. 6A and 6B illustrate top plan views of the first kayak embodiment in unfolded and folded configurations.
Figure 6B:
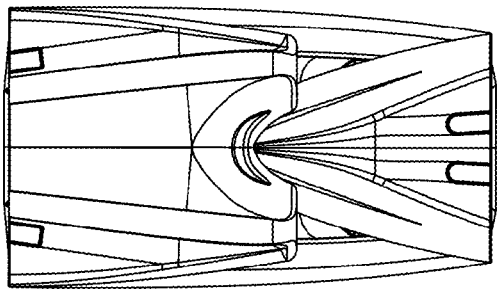
Figure 7A:
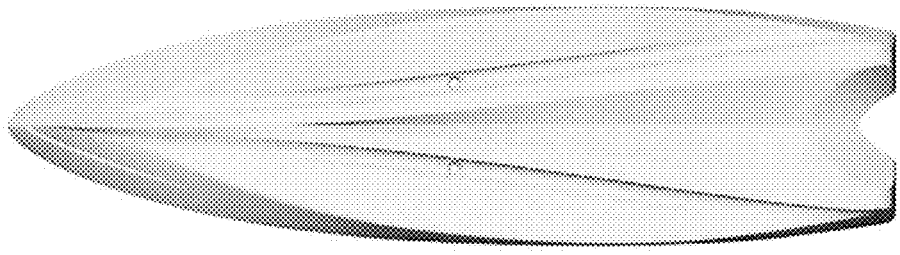
FIG. 7A is a bottom plan view of the hull of the first kayak embodiment.
Figure 7B:
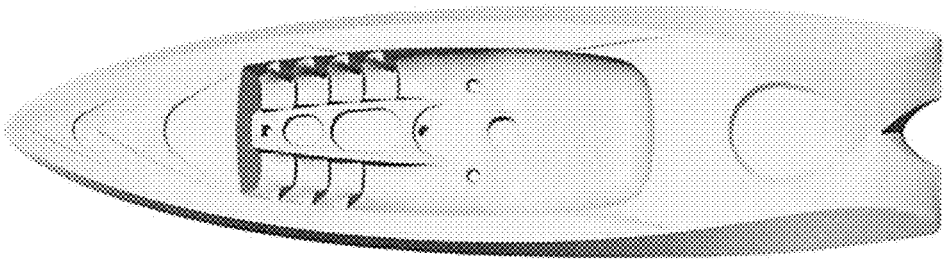
FIG. 7B is a top plan view of the hull of the first kayak embodiment.
Figure 7C:
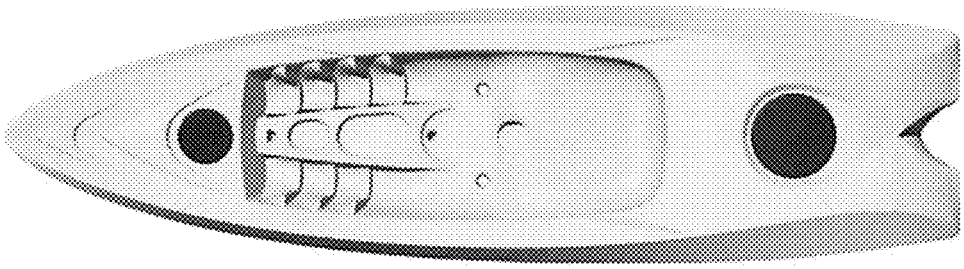
FIG. 7C is a top plan view of the hull of the first kayak embodiment showing hatch covers installed over hatch openings.
Figure 7D:
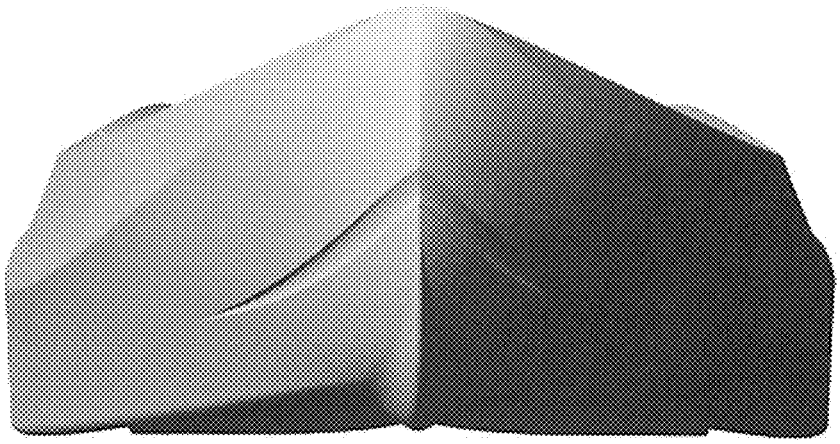
FIG. 7D is a front end elevation view of a bow end of the first kayak embodiment.
Figure 7E:
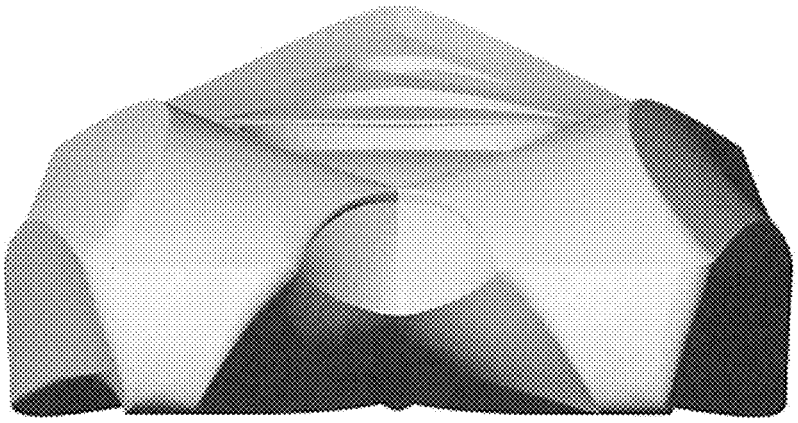
FIG. 7E is a rear end elevation view of a stern end of the first kayak embodiment.
Figure 7F:
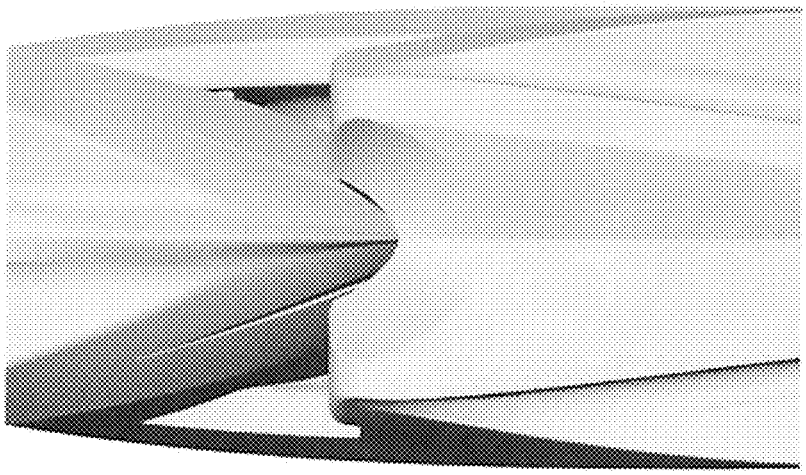
FIG. 7F is a top plan view of the first kayak embodiment in the folded configuration.
Figure 7G:
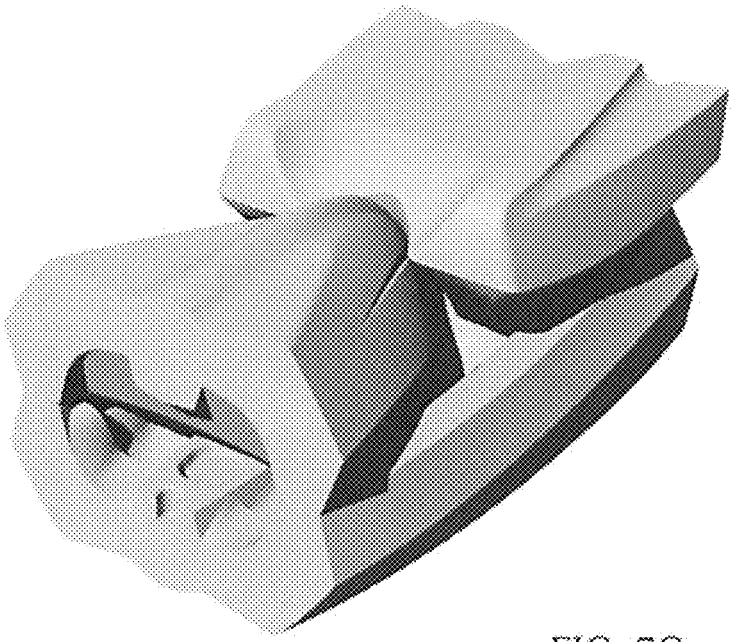
FIG. 7G is a perspective view of the first kayak embodiment in the folded configuration.
Figure 7H:
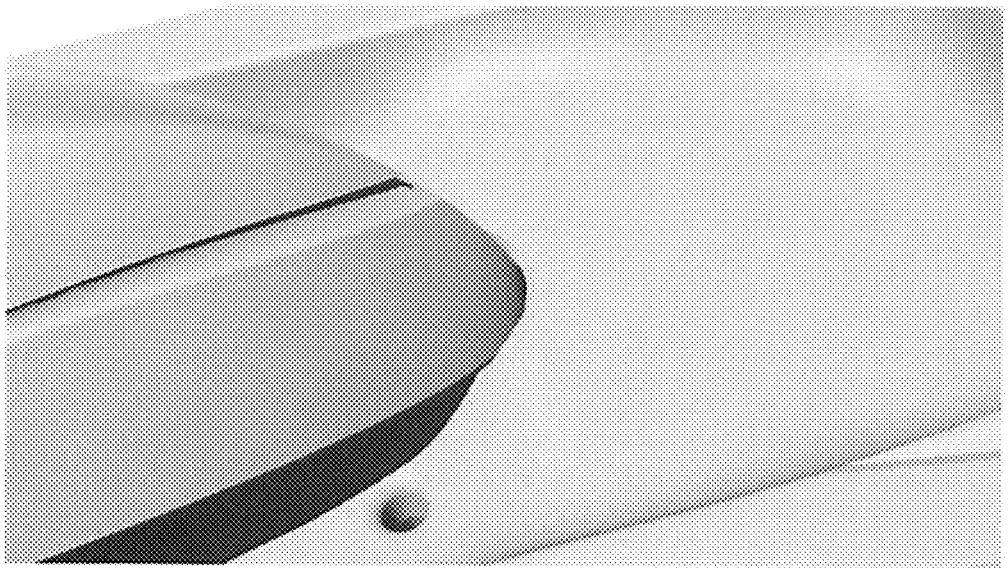
FIG. 7H is a close up perspective view of the first kayak embodiment in the folded configuration illustrating how the bow nests within a notch in the stern.
Figure 8A:
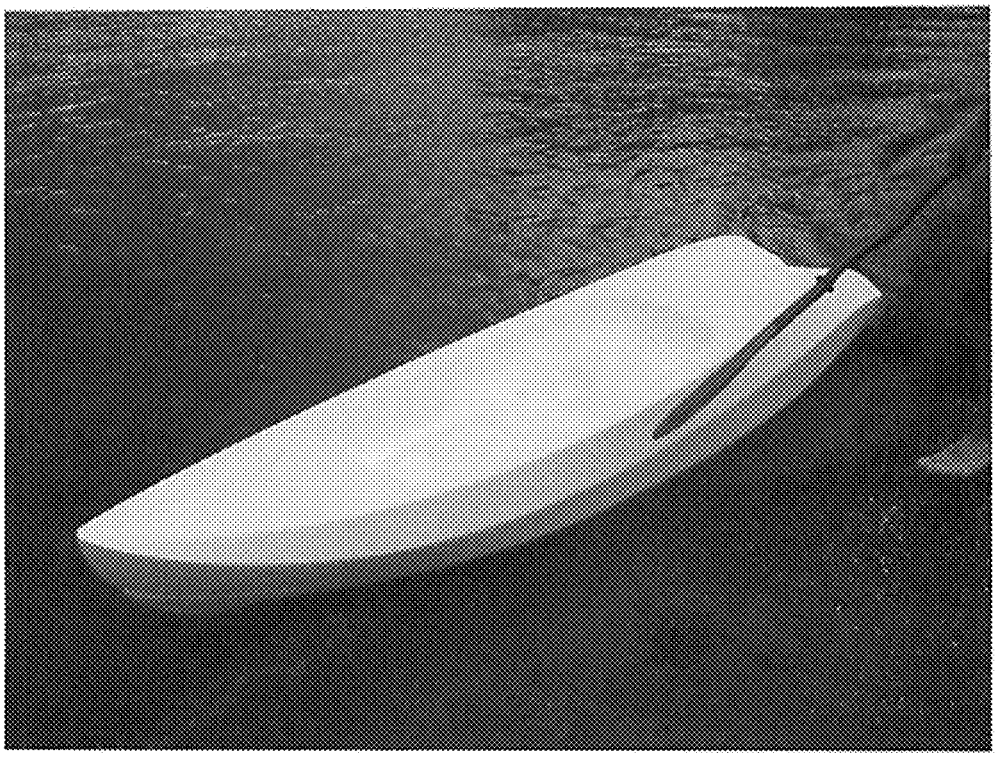
FIG. 8A is a perspective view of an example kayak plug embodiment of the present invention.
Figure 8B:
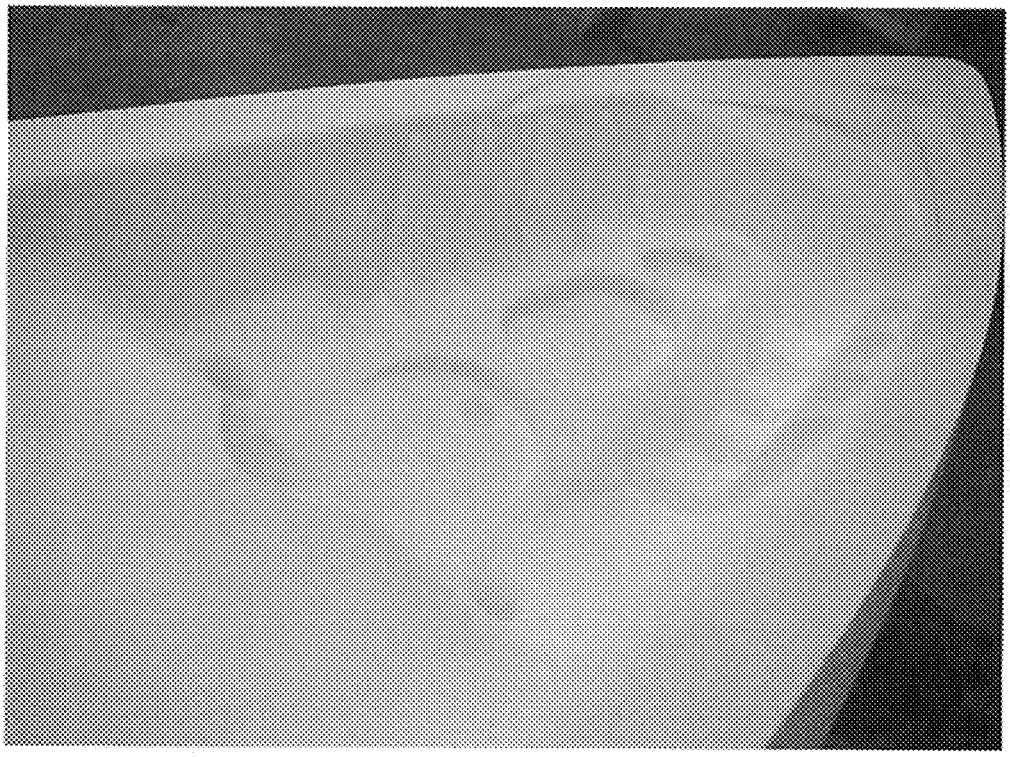
FIG. 8B is a perspective view of a bow section and a portion of a center section of the example kayak plug embodiment.
Figure 8C:
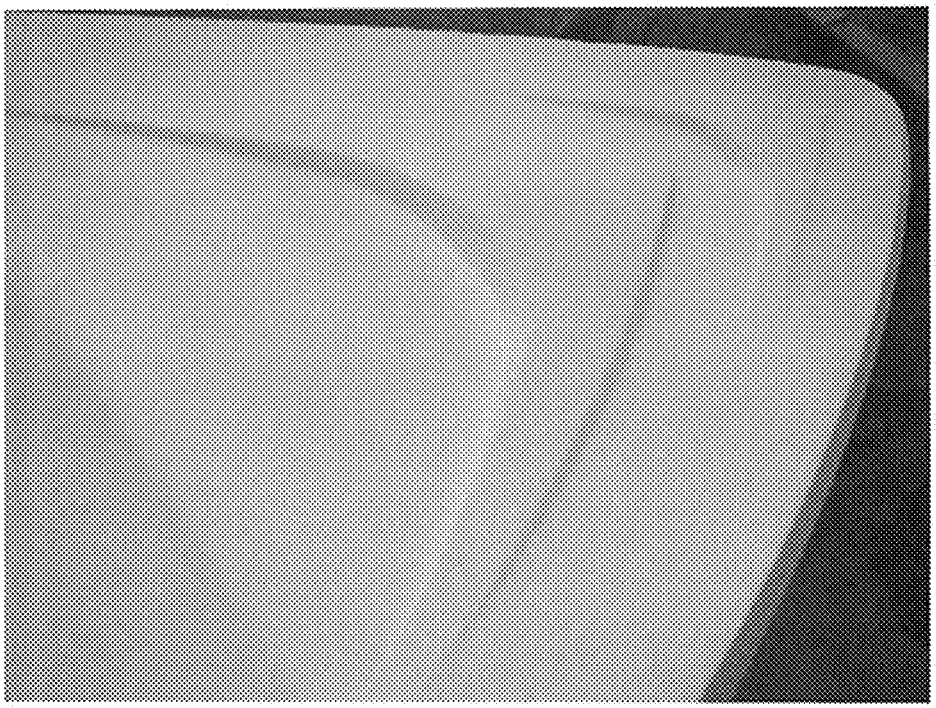
FIG. 8C is a perspective view of a portion of the bow section of the example kayak plug embodiment.
Figure 8D:
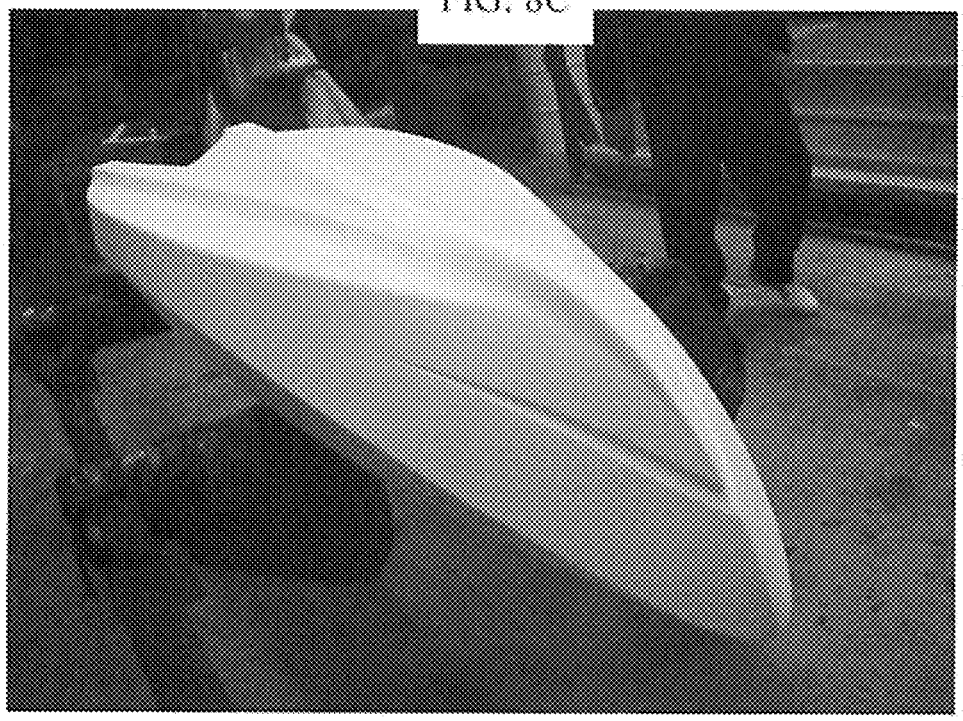
FIG. 8D is a perspective view of a bottom of the example kayak plug embodiment taken from the bow end.
Figure 8E:
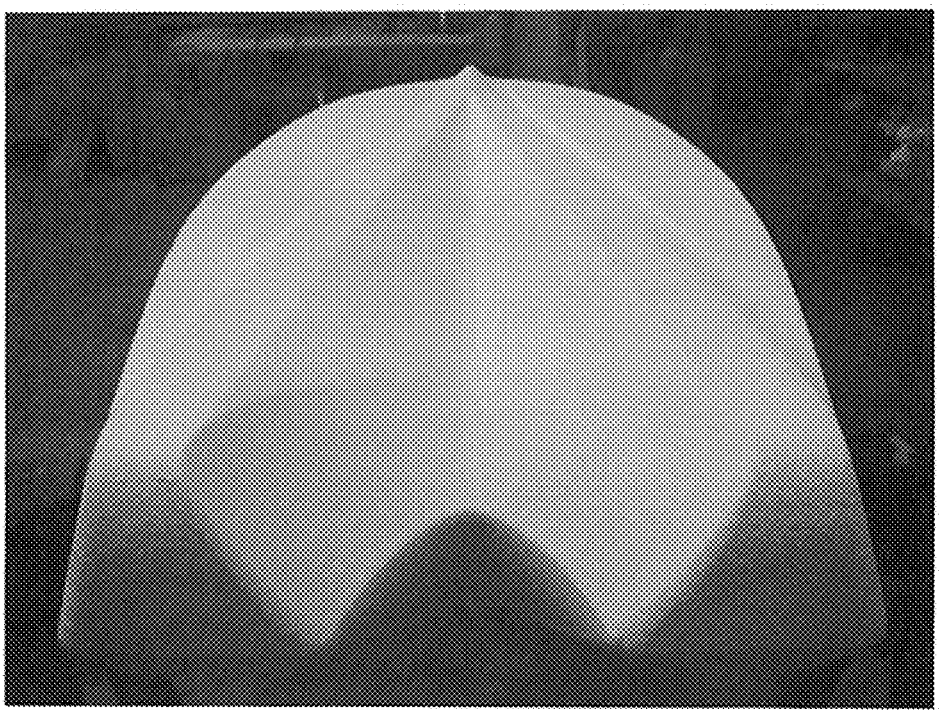
FIG. 8E is a rear end view illustrating a bottom of the example kayak plug embodiment taken from the stern end.
Figure 8F:
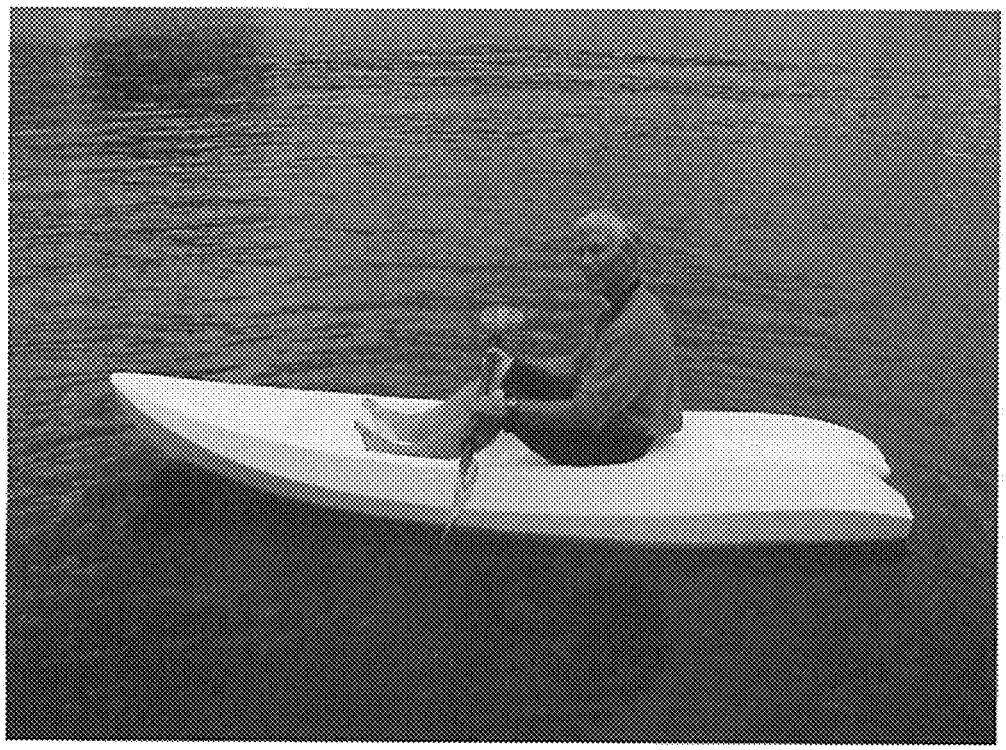
FIG. 8F is a perspective view illustrating the example kayak plug embodiment in use on the water.
Figure 9A:
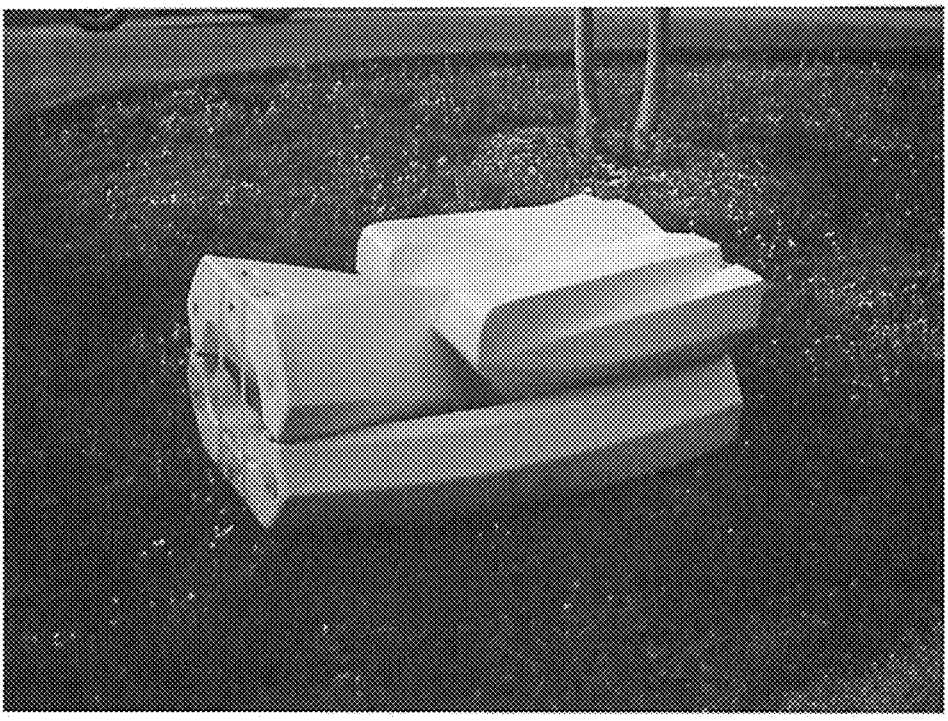
FIG. 9A is a perspective view of a second example embodiment of a kayak of the present invention in a folded configuration.
Figure 9B:
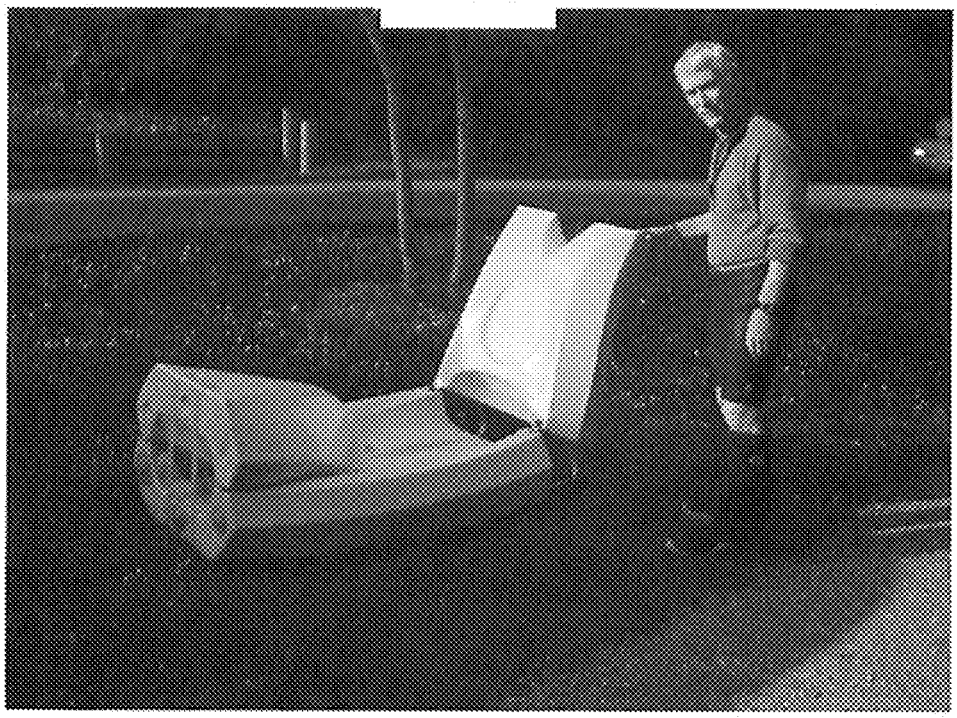
FIG. 9B is a perspective view of the second example kayak embodiment illustrating the unfolding of a stern section of the kayak from a folded position into an unfolded position.
Figure 9C:
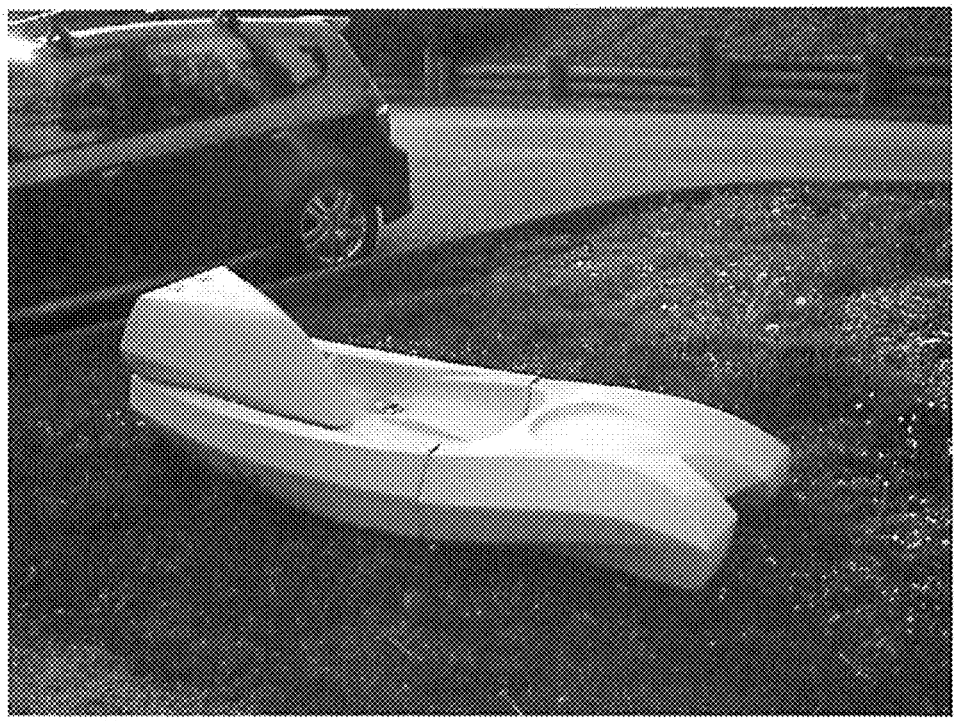
FIG. 9C is a perspective view of the second example kayak embodiment illustrating the stern section of the kayak in its unfolded position and the bow section in a folded position.
Figure 9D:
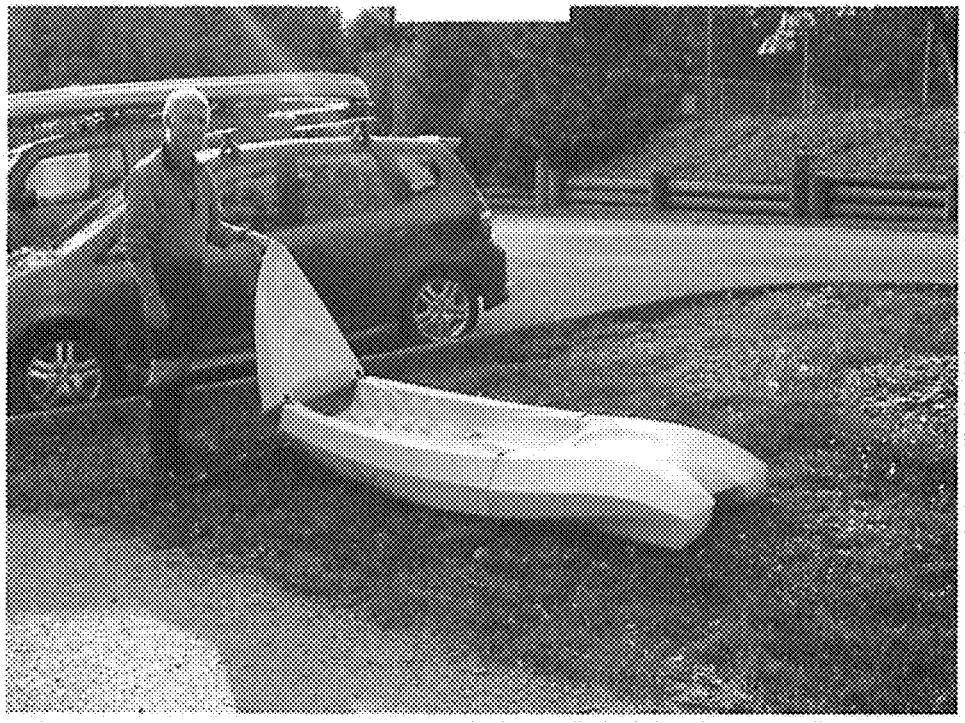
FIG. 9D is a perspective view of the second example kayak embodiment illustrating the unfolding of the bow section of the kayak from its folded position into an unfolded position.
Figure 9E:
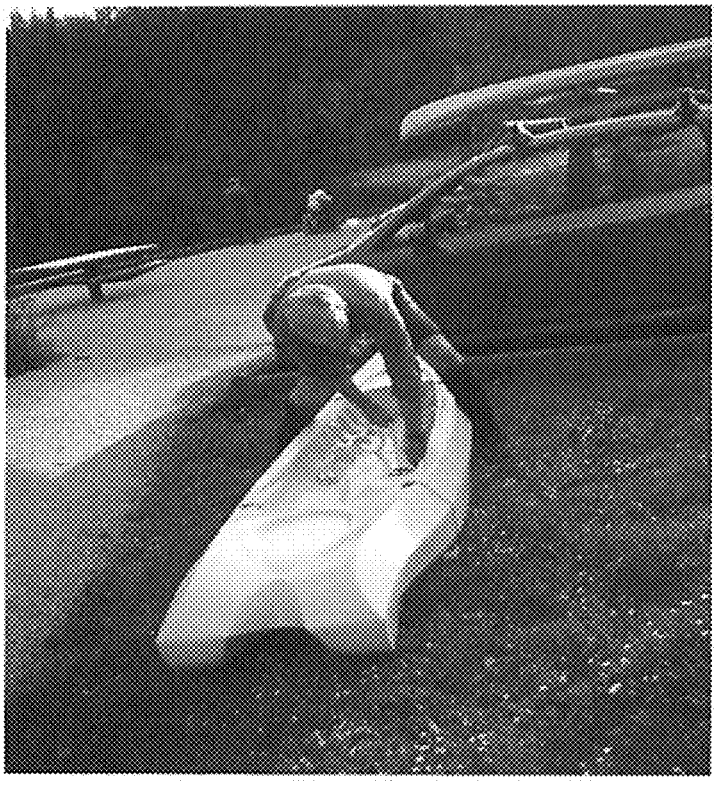
FIG. 9E illustrates the adjusting of straps to lock the second example kayak configuration such that both the bow and the stern are held in the unfolded positions such that the second example kayak configuration is locked in its unfolded configuration.
Figure 9F:
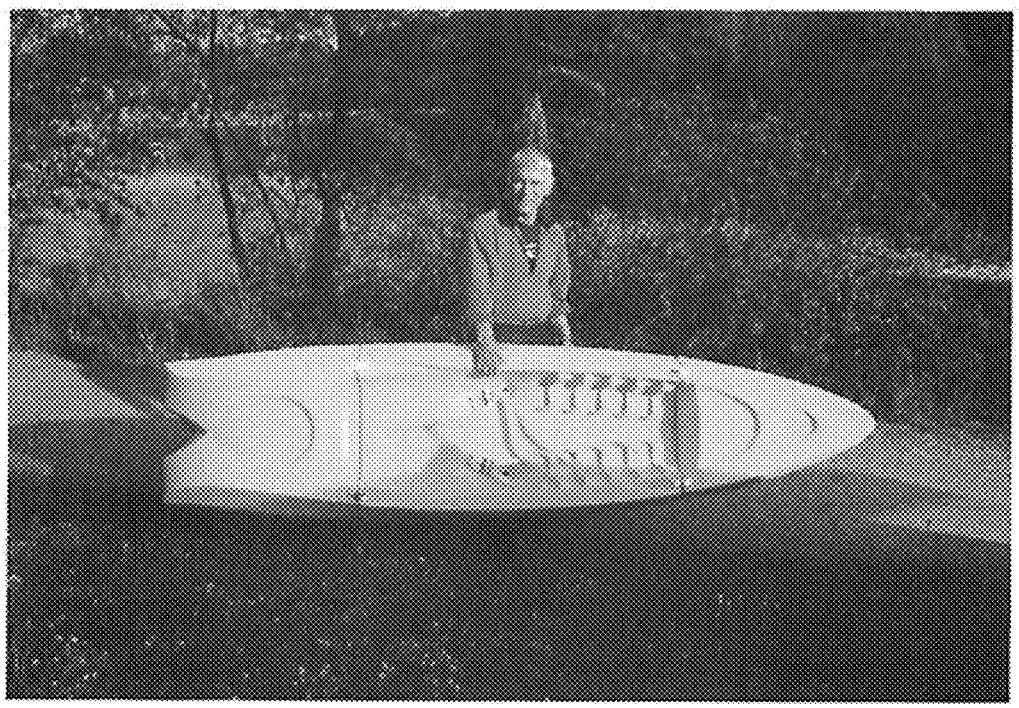
FIG. 9F illustrates the carrying of the second example kayak embodiment in the unfolded configuration.
Figure 9G:
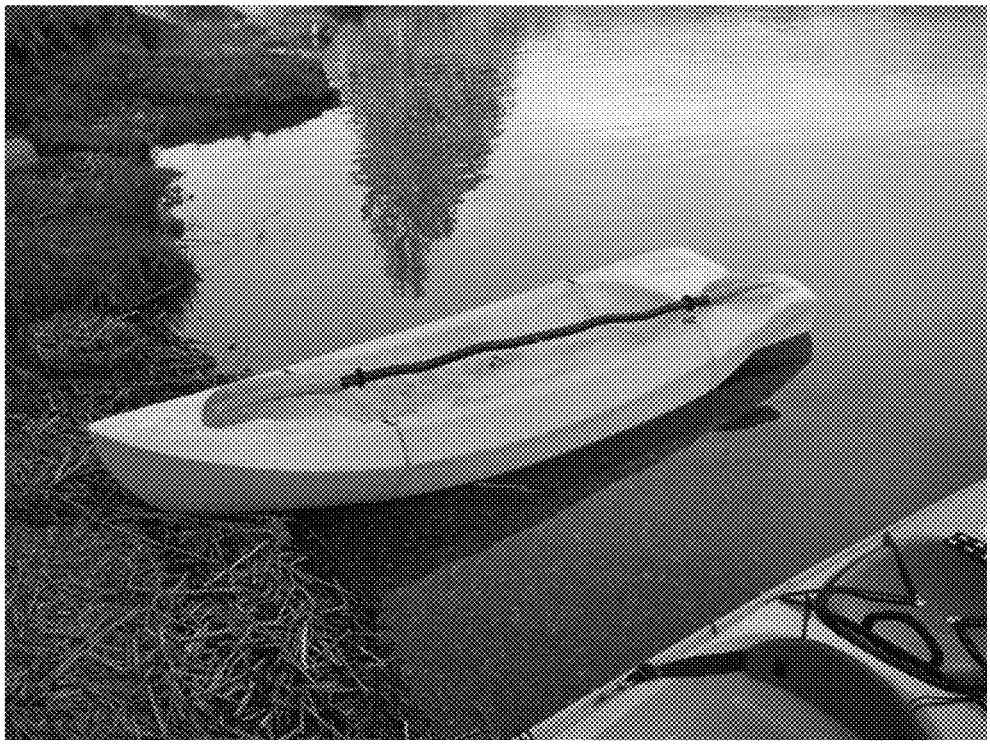
FIG. 9G illustrates the second example kayak embodiment floating on the water.
Figure 9H:
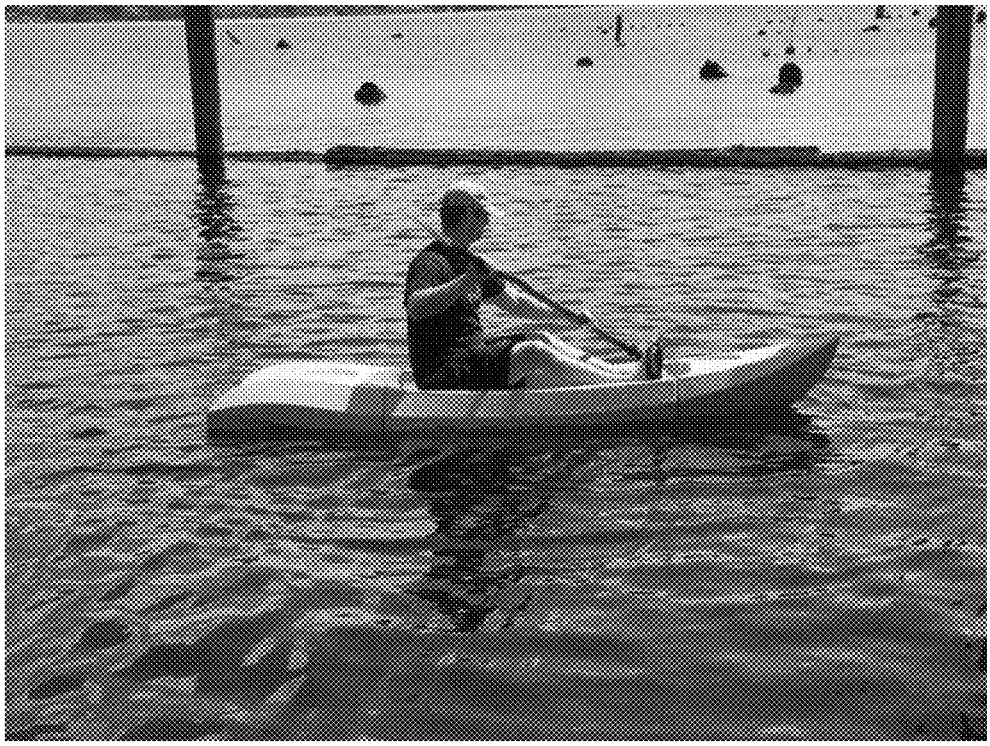
FIG. 9H illustrates the second example kayak embodiment being paddled on the water.

FIGS. 4, 5, and 6 further illustrate the three sections of the kayak 20. FIG. 4 illustrates that the stern section 26 has a substantially flat tail end with the notch or groove portion 34; the example notch or groove portion 34 is a v-shaped groove cut into the center of the tail or stern end. The bow defines the bow line 36, and the notch or groove portion 34 is sized and dimensioned to receive the bow line 36 when the kayak 20 is in the folded configuration. This may allow the stern and the bow sections to be folded directly onto the center section, with the bow and stern sections 22 and 26 overlapping but without these sections interfering. This may allow for a more compact design, as the v-shaped notch in the stern section can receive the pointed nose of the bow section. The compact design may facilitate easier storage, transport and usability of the kayak.

FIG. 5 illustrates a perspective view of the folding kayak in folded and unfolded positions. FIG. 6 illustrates top views of the folding kayak in folded and unfolded positions. As previously mentioned, the various sections of the folding kayak may include latches, clasps, grooves or other fastening mechanisms that automatically fasten when folded. As such, a user may simply fold the bow and stern sections toward the center section until the interlocking of adjacent sections is heard as a clicking sound or felt. This clicking sound may signify that the two sections have fully shut and that the sections are fastened to the center section. Once fastened in this manner, the folded kayak may be handled as a single-section kayak.

FIGS. 7A-7H are a series of colored and shaded drawings that show embodiments of the folding kayak in various views and forms.

The folding kayak embodiments of 7A-7H advantageously may not require assembly—the user can simply fold or unfold the kayak and go. For example, the various sections may be connected via fastening means. In some embodiments, the bow and stern sections may be connected to the center section via two hinges on the top gunnels. Additionally or alternatively, the bow and stern sections may be connected on the bottom using latches. The latches may include rubber components that allow for expansion and contraction. For instance, if the kayak is constructed from plastic, the rubber components may allow the plastic to expand and contract with changes in temperature without the latches damaging the kayak. Still further, in some cases, the bow and stern sections may be hinged on an axis other than perpendicular. Accordingly, in such cases, the bow and stern sections may be hinged at different angles to allow longer bow and stern portions to be folded diagonally inward at an angle that allows the two longer portions to be folded flat against the center section while not overlapping each other.

The following is a series of pictures that show a prototype of the folding kayak in various views and forms. In particular, FIGS. 8A-8E illustrate an example folding kayak plug or model used in testing the seaworthiness of the hull when in the unfolded configuration. FIGS. 9A-G illustrate a working prototype and the process of converting the working prototype from a folded configuration into an unfolded configuration and the use of the working prototype.

Figure 10A:
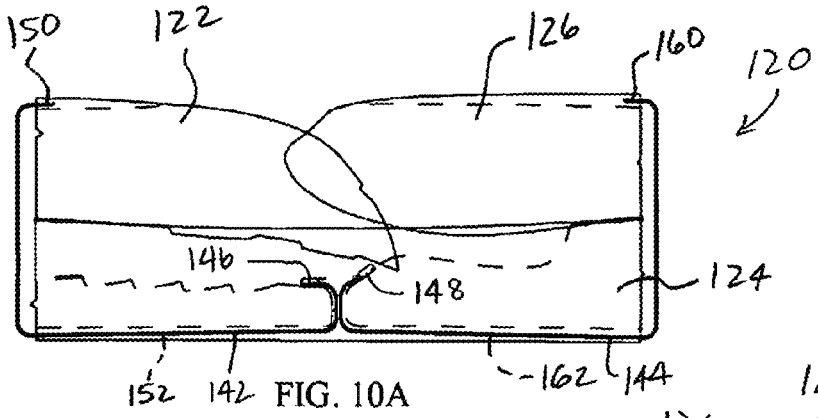
FIGS. 10A and 10B illustrate a first example strap/buckle adjustment system for securing three sections of an example foldable kayak in a folded configuration and an unfolded configuration, respectively.
Figure 10B:
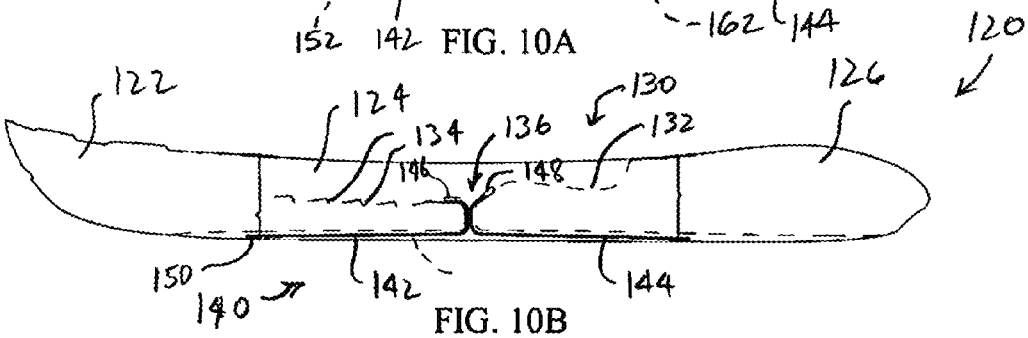

FIGS. 10A and 10B illustrate another foldable kayak 120 of the present invention having a bow section 122, a center section 124, and a stern section 126. When in an unfolded configuration, the foldable kayak defines a cockpit area 130 having a seating surface 132 and a plurality of footrest surfaces 134. A scupper opening 136 is formed in the center section 124 between the seating surface 132 and the footrest surfaces 134.

A length of the center section 124 of the example kayak 120 is approximately 40% of the entire length of the kayak 120 in its unfolded configuration. The overlapping of the bow section 122 with the stern section 126 when the kayak 120 is in the folded configuration allows the length of the kayak 120 to be as long as possible in the unfolded configuration but as short as possible when in the folded configuration.

The foldable kayak 120 further comprises an example securing system 140 to connect the three sections 122, 124, and 126 together. The example securing system 140 comprise a first strap 142, a second strap 144, a first buckle 146, and a second buckle 148.

The first strap 142 extends from a first anchor point 150 located at the bottom of the bow section 122 adjacent to a bulkhead 122*a* thereof, through a first groove portion 152 in the center section 124, and up through the scupper opening 136 formed in the center section 124. A first end of the first strap 132 is secured to the anchor point 150, while a second end of the first strap 132 lies within the cockpit area 130 between the seating surface 132 and the footrest surfaces 134. The example first buckle 146 is secured to the center section 124 forward of the scupper opening 126.

The second strap 144 extends from a second anchor point 160 located at the bottom of the stern section 126 adjacent to a bulkhead 126*a* thereof, through a second groove portion 162 in the center section 124, and up through the scupper opening 136 formed in the center section 124. A first end of the second strap 132 is secured to the anchor point 160, while a second end of the second strap 132 is within the cockpit area 130 between the seating surface 132 and the footrest surfaces 134. The example second buckle 148 is secured to the center section 124 aft of the scupper opening 126.

The first and second straps 142 and 144 are long enough such that the second ends thereof remain in the cockpit area when the kayak 120 is in the folded configuration of FIG. 10A. Slack is initially introduced in the straps 142 and 144 when the bow and stern sections 122 and 126 are rotated into their unfolded positions relative to the center section 124 to place the kayak in the unfolded configuration. Pulling second ends of the straps 142 and 144 takes up any slack. The first and second straps 142 and 144 are pulled through the first and second buckles 146 and 148, respectively, such that sufficient tension is applied to the straps 142 and 144 to secure the bow, center, and stern sections 122, 124, and 126 in the unfolded configuration. The location of the buckles 146 and 148 in the cockpit area 130 allows the operator of the kayak 120 easily to access these buckles while sitting on the seating surface 132 and, if necessary, to apply additional tension to the straps 142 and 144 during operation of the kayak 120.

The buckles 146 and 148 secure the second ends of the straps 142 and 144 relative to the center section 124 to maintain tension on the straps. Ratchet type buckles may be used to increase tension on the straps 142 and 144. It may also be possible to pass both of the second ends of the first and second straps 142 and 144 through a single buckle to maintain tension on the straps 142 and 144.

The straps 142 and 144 may be made of conventional strapping material made of nylon webbing or the like. The material and construction of the straps 142 and 144 preferably should avoid significant stretching when exposed to water and other environmental factors. However, any strapping material with sufficient strength to withstand the loads on the sections 122, 124, and 126 can be used by applying more tension on the straps 142 and/or 144 should stretching of these straps occur during use of the kayak 120 in the unfolded configuration.

Figure 11A:
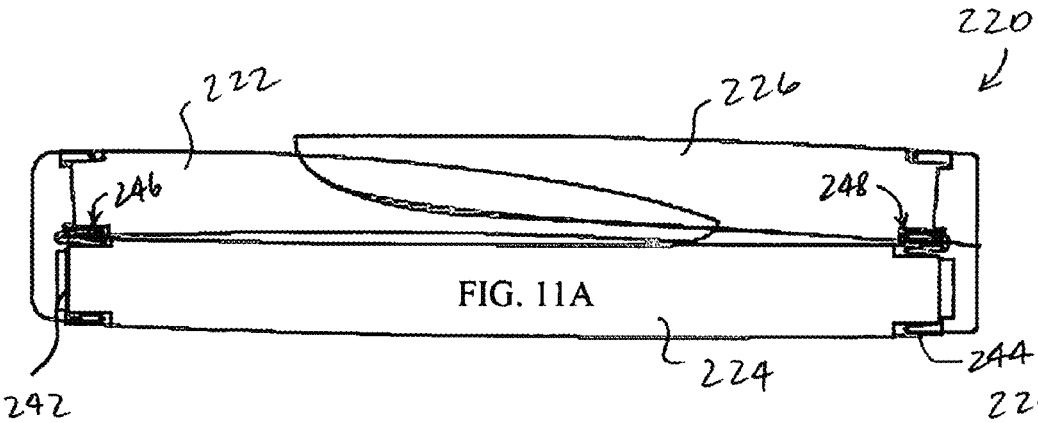
FIGS. 11A and 11B illustrate a second example strap/buckle adjustment system for securing three sections of a foldable paddle board in a folded configuration and an unfolded configuration, respectively.
Figure 11B:
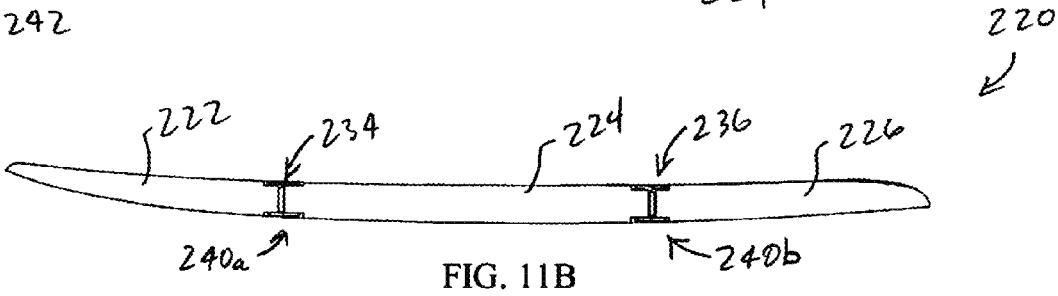

FIGS. 11A and 11B illustrate an example foldable paddle board 220 of the present invention having a bow section 222, a center section 224, and a stern section 226. When in an unfolded configuration, the foldable paddle board defines a standing area 230 having a standing surface 232. A first hinge assembly 234 is connected to the upper surfaces of the bow section 222 and the center section 224. A second hinge assembly 236 is connected to the upper surfaces of the center section 224 and the stern section 226.

The foldable paddle board 220 further comprises first and second securing systems 240*a* and 240*b* to hold the three sections 222, 224, and 226 together in an unfolded configuration during use. The example first securing system 240*a* comprise a first strap 242 and a first buckle 246, while the example second securing system 240*b* comprises a second strap 244 and a second buckle 248.

Figure 12:
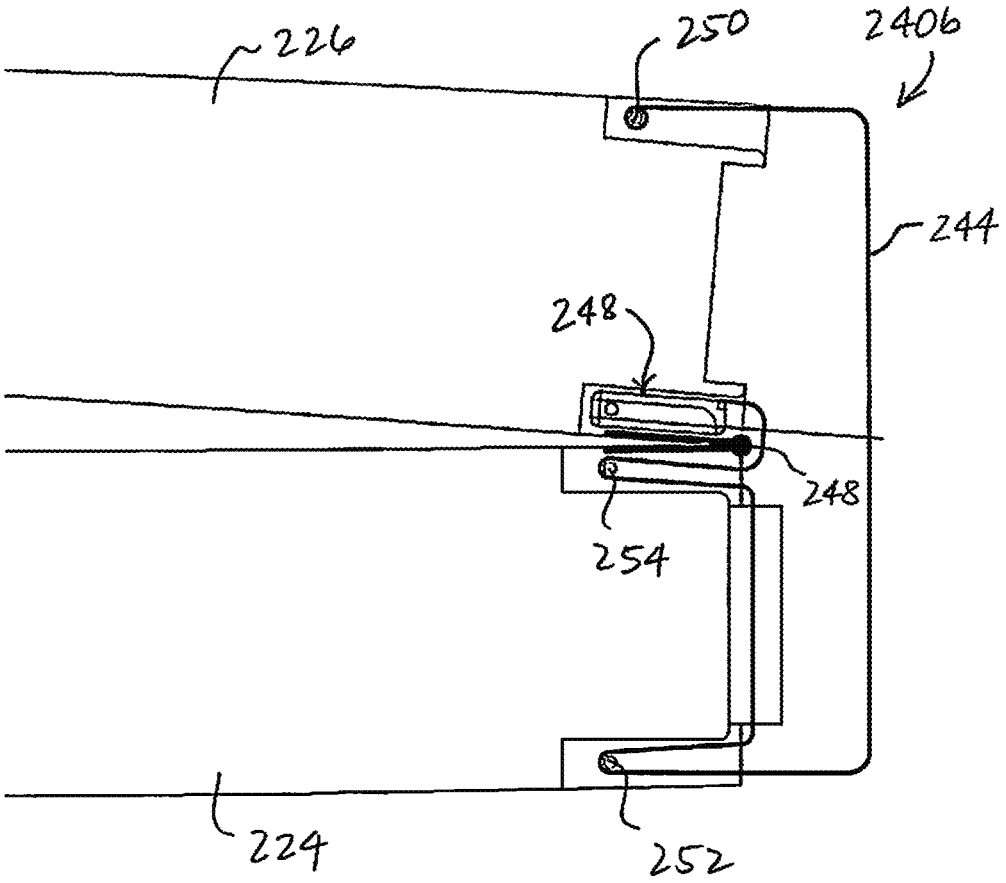
FIG. 12 illustrates in a second example strap/buckle adjustment system that may be used to join together two sections of an example foldable kayak of the present invention.
Figure 13A:
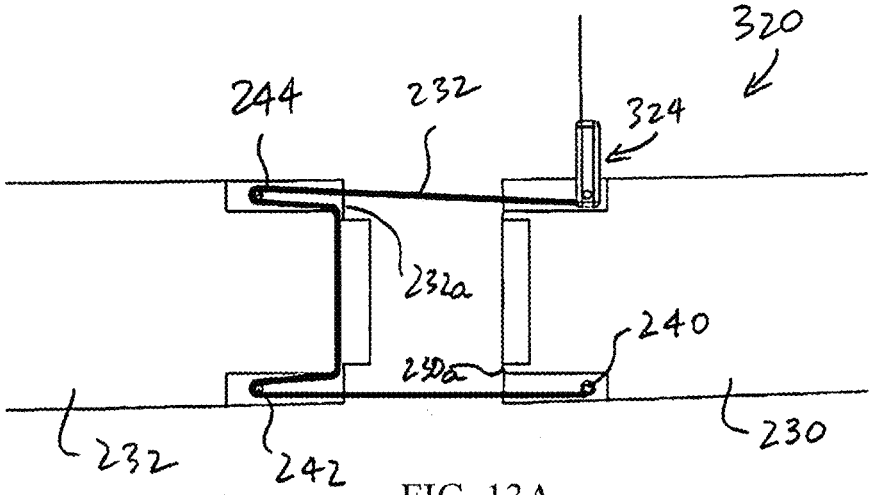
FIGS. 13A and 13B illustrate another example strap/buckle adjustment system that may be used in loose and tight configurations, respectively, to join together two sections of an example foldable kayak of the present invention.
Figure 13B:
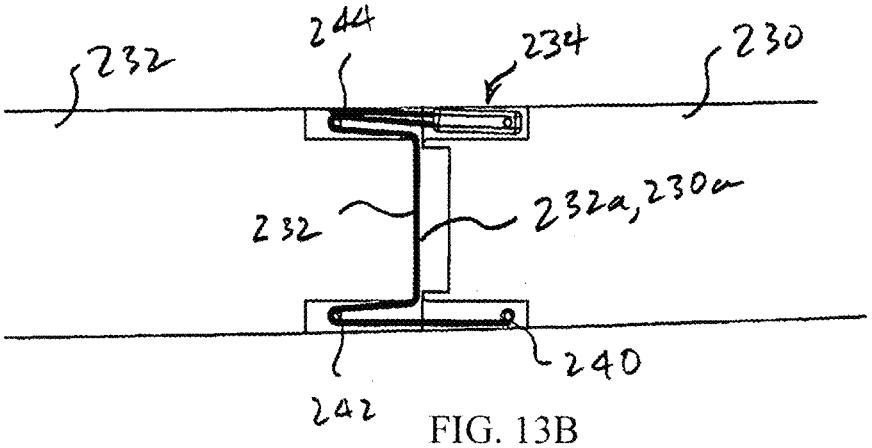

The example first and second securing systems 240*a* and 240*b* are used in substantially the same manner, and only the second securing system 240*b* is depicted in detail in FIG. 12 of the drawing. The second strap 244 extends from an anchor point 250 located at the bottom of the stern section 226 adjacent to a bulkhead 222*a*, around a first tension pin 252, around a second tension pin 254, around the second hinge assembly 236, and up through the second buckle 248. A first end of the second strap 244 is secured to the anchor point 250, while a second end of the first strap 232 extends through the second buckle 248. The example second buckle 248 is secured to the stern section 226.

The first and second straps 242 and 244 are long enough such that the second ends thereof remain in the buckles 246 and 248 when the paddle board 220 is in the folded configuration of FIG. 11A. Slack is initially introduced in the straps 242 and 244 when the bow and stern sections 222 and 226 are rotated into their unfolded positions relative to the center section 224 to place the paddle board in the unfolded configuration. Pulling second ends of the straps 242 and 244 takes up any slack. The first and second straps 242 and 244 are pulled through the first and second buckles 246 and 248, respectively, such that sufficient tension is applied to the straps 242 and 244 to secure the bow, center, and stern sections 222, 224, and 226 in the unfolded configuration.

The buckles 246 and 248 secure the second ends of the straps 242 and 244 relative to the bow and stern sections 222 and 226, respectively, to maintain tension on the straps. Ratchet type buckles may be used to increase tension on the straps 242 and 244. It may also be possible to pass both of the second ends of the first and second straps 242 and 244 through a single buckle to maintain tension on the straps 242 and 244.

The straps 242 and 244 may be made of conventional strapping material made of nylon webbing or the like. The material and construction of the straps 242 and 244 preferably should avoid significant stretching when exposed to water and other environmental factors. However, any strapping material with sufficient strength to withstand the loads on the sections 222, 224, and 226 can be used by applying more tension on the straps 242 and/or 244 should stretching of these straps occur during use of the paddle board 220 in the unfolded configuration.

Figure 14A:
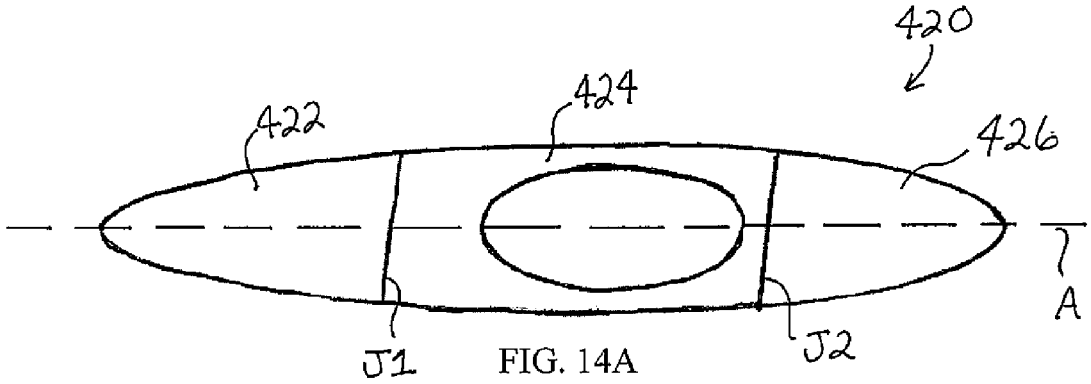
FIGS. 14A and 14B illustrate another example foldable kayak of the present invention.
Figure 14B:
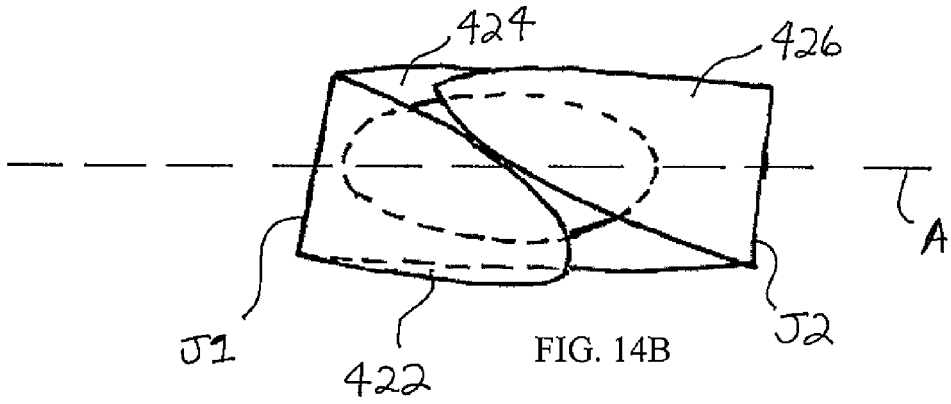

FIGS. 14A and 14B illustrate another example securing system 320 that may be used in place of the hinge assemblies 234 and 236 and associated securing systems 240*a* and 240*b* described above. The example securing system 320 comprises a strap 322 and a buckle 324 for securing a first section 330 of a folding kayak to a second section 332 thereof. The first and second sections may be any adjacent pair of the bow, center, and stern sections of a foldable kayak.

The buckle 324 is secured to the first section 330. The strap 322 is secured to an anchor point 340 located on the first section 230, extends around a first pin 342 on the second section 332, around a second pin 344 on the second section 332, and then through the buckle 324. Between the first and second pins, the strap 322 overlies a bulkhead surface 332*a* on the second section 332.

The strap 322 is long enough such that the second end thereof remains in the buckle 324 when the paddle board 220 is in the folded configuration; the strap 322 essentially acts as a living hinge to hold the first and second sections together. Slack is initially introduced in the straps 242 and 244 when the bow and stern sections 222 and 226 are rotated into their unfolded positions relative to the center section 224 to place the paddle board in the unfolded configuration. Pulling the second end of the strap 322 takes up any slack. The strap 322 is pulled through the buckle 324 such that sufficient tension is applied to the strap 322 to secure the bow, center, and stern sections together in the unfolded configuration. When the adjacent sections 230 and 232 are pulled together, the strap 322 lies between the bulkheads 230*a* and 232*a* of the sections 230 and 232. Grooves may be formed in one or both of the bulkheads 230*a* and 232*a* to accommodate the strap 322.

The buckle 324 secures the second end of the strap 322 relative to the first section to maintain tension on the strap 322. Ratchet type buckles may be used to increase tension on the strap 322.

The strap 324 may be made of conventional strapping material made of nylon webbing or the like. The material and construction of the strap 324 preferably should avoid significant stretching when exposed to water and other environmental factors. However, any strapping material with sufficient strength to withstand the loads on the sections 222, 224, and 226 can be used by applying more tension on the straps 242 and/or 244 should stretching of these straps occur during use of the paddle board 220 in the unfolded configuration.

FIGS. 14A and 14B illustrate another modular, foldable kayak 420 of the present invention. The example kayak 420 comprises bow, center, and stern sections 422, 424, and 426. First and second juncture lines J1 and J2 between the bow section 422 and center section 424 and between the center section 424 and stern section 426 are angled with respect to a longitudinal axis A of the kayak 420. This allows the bow and stern sections 422 and 426 to overlap substantially when the kayak is in the folded configuration as depicted in FIG. 14B. This arrangement may be preferred for longer kayaks adapted for use on salt water.

Accordingly, a modular, foldable kayak is disclosed. The foldable kayak may include three sections, where the bow and stern sections fold toward each other on top of a center section. The bow and stern sections may be attached via a variety of different fastening mechanisms and may be structurally supported via different integral geometric members. Each section may have its own bulkhead, allowing each section to provide an independent vessel. Because of the folding kayak's design, it may be folded into a compact unit, and may be easily carried or stored.

The embodiments described herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration;

the at least one strap assembly comprises a first strap and a second strap;

a first end of the first strap is anchored to the bow section;

a first end of the second strap is anchored to the stern section; and the at least one buckle assembly secures a second end of the first strap and a second end of the second strap relative to the center section.

2. A foldable watercraft as recited in claim 1, in which the watercraft is a kayak.

3. A foldable watercraft as recited in claim 1, in which the watercraft is a paddle board.

4. A method of forming watercraft comprising the steps of:

providing a bow section defining a bow engaging surface, a bow hull surface, and a bow deck surface;

providing a center section defining a first center engaging surface, a second center engaging surface, a center hull surface, and a center deck surface;

providing a stern section defining a stern engaging surface, a stern hull surface, and a stern deck surface;

forming at least one cavity in at least one of the bow section and the stern section;

providing at least one strap assembly;

providing at least one buckle assembly;

engaging the at least one buckle assembly with the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and while placing the watercraft in the folded configuration, causing the at least one cavity to receive a portion of at least one of the bow and stern sections.

5. A method as recited in claim 4, further comprising the steps of:

forming a first recess in one of the bow engaging surface and the first center engaging surface;

forming a first projection in the other of the bow engaging surface and the first center engaging surface;

forming a second recess in one of the stern engaging surface and the second center engaging surface;

forming a second projection in the other of the stern engaging surface and the second center engaging surface; and while placing the watercraft in the use configuration, causing the first recess to receive the first projection, and causing the second recess to receive the second projection.

6. A method as recited in claim 4, further comprising the steps of:

forming at least one cavity in the center section; and while placing the watercraft in the folded configuration, causing the at least one cavity to receive portions of the bow and stern sections.

7. A paddle board comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising a plurality of strap assemblies, and a plurality of buckle assemblies; wherein the first and second buckle assemblies is configured to engage the first and second strap assemblies selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive portions of the bow and stern sections when the watercraft is in the folded configuration;

the securing system comprises a first strap assembly, a second strap assembly, a third strap assembly, a fourth strap assembly, a first buckle assembly, a second buckle assembly, third buckle assembly, and a fourth buckle assembly;

the first buckle assembly engages the first strap assembly and the second buckle assembly engages the third strap assembly to allow the watercraft to be arranged in the folded configuration, and the third buckle assembly engages the third strap assembly and the fourth buckle assembly engages the fourth strap assembly to allow the watercraft to be arranged in the folded configuration; and the first buckle assembly engages the first strap assembly and the second buckle assembly engages the third strap assembly to secure the watercraft in the use configuration, and the third buckle assembly engages the third strap assembly the fourth buckle assembly engages the fourth strap assembly to secure the watercraft in the use configuration.

8. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration;

the securing system comprises a first strap assembly, a second strap assembly, a third strap assembly, a fourth strap assembly, a first buckle assembly, a second buckle assembly, a third buckle assembly, and a fourth buckle assembly;

the first buckle assembly engages the first strap assembly and the second buckle assembly engages the third strap assembly to allow the watercraft to be arranged in the folded configuration, and the third buckle assembly engages the third strap assembly and the fourth buckle assembly engages the fourth strap assembly to allow the watercraft to be arranged in the folded configuration; and the first buckle assembly engages the first strap assembly and the second buckle assembly engages the third strap assembly to secure the watercraft in the use configuration, and the third buckle assembly engages the third strap assembly the fourth buckle assembly engages the fourth strap assembly to secure the watercraft in the use configuration.

9. A foldable watercraft as recited in claim 8, in which:

the first strap assembly comprises a first strap and a second strap;

the second strap assembly comprises a third strap and a fourth strap;

the third strap assembly comprises a fifth strap and a sixth strap;

the fourth strap assembly comprises a seventh strap and an eighth strap;

first ends of the first and second straps are anchored to the bow section;

first ends of the third and fourth straps are anchored to the center section;

first ends of the fifth and sixth straps is anchored to the stern section;

first ends of seventh and eight straps are anchored to the center section;

the first and second buckle assemblies secure second ends of the first and second straps relative to second ends of the third and fourth straps, respectively; and the third and fourth buckle assemblies secure second ends of the fifth and sixth straps relative to second ends of the seventh and eighth straps, respectively.

10. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration;

the at least one strap assembly comprises a first strap and a second strap;

a first end of the first strap is anchored to the bow section;

a first end of the second strap is anchored to the stern section;

the at least one buckle assembly secures a second end of the first strap and a second end of the second strap relative to the center section;

the securing system comprises a first strap assembly, a second strap assembly, a first buckle assembly, and a second buckle assembly;

the first and second buckle assemblies engages the first and strap assemblies, respectively, to allow the watercraft to be placed in the folded configuration;

the first and second buckle assemblies engage the first and second strap assemblies, respectively, to secure watercraft in the use configuration;

the first strap assembly comprises a first strap and a second strap;

the second strap assembly comprises a third strap and a fourth strap;

a first end of the first strap is anchored to the bow section;

a first end of the second strap is anchored to the center section;

a first end of the third strap is anchored to the stern section;

a first end of the fourth strap is anchored to the center section;

the first buckle assembly secures a second end of the first strap relative to a second end of the second strap; and the second buckle assembly secures a second end of the third strap relative to a second end of the fourth strap.

11. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration;

a first recess is formed in one of the bow engaging surface and the first center engaging surface;

a first projection is formed in the other of the bow engaging surface and the first center engaging surface;

a second recess is formed in one of the stern engaging surface and the second center engaging surface;

a second projection is formed in the other of the stern engaging surface and the second center engaging surface; and when the watercraft is in the use configuration, the first recess is adapted to receive the first projection and the second recess is adapted to receive the second projection.

12. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration;

a first recess is formed in one of the bow engaging surface and the first center engaging surface;

a first projection is formed in the other of the bow engaging surface and the first center engaging surface;

a second recess is formed in one of the stern engaging surface and the second center engaging surface;

a second projection is formed in the other of the stern engaging surface and the second center engaging surface; and when the watercraft is in the use configuration, the first recess is adapted to receive the first projection and the second recess is adapted to receive the second projection.

13. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration; and at least one cavity is formed in at least one of the bow section and the stern section to accommodate a portion of one of the bow section and the stern section when the watercraft is in the folded configuration.

14. A foldable watercraft comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising at least one strap assembly, and at least one buckle assembly; wherein the at least one buckle assembly is configured to engage the at least one strap assembly selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive a portion of at least one of the bow and stern sections when the watercraft is in the folded configuration; and at least one of the bow section and the stern section are angled to accommodate a portion of the other of the bow section and the stern section when the watercraft is in the folded configuration.

15. A paddle board comprising:

a bow section defining a bow engaging surface, a bow hull surface, and a bow deck surface;

a center section defining a first center engaging surface, a second center engaging surface, a center hull surface, and a center deck surface;

a stern section defining a stern engaging surface, a stern hull surface, and a stern deck surface;

a securing system comprising a plurality of strap assemblies, and a plurality of buckle assemblies; wherein the first and second buckle assemblies is configured to engage the first and second strap assemblies selectively to arrange the watercraft in a folded configuration and a use configuration, where in the folded configuration, the bow deck surface and the stern deck surface overlap the center deck surface; and in the use configuration the bow deck surface, center deck surface, and stern deck surface are arranged to define a cockpit of the watercraft, and the bow hull surface, center hull surface, and stern hull surface are arranged to define a hull of the watercraft; and the center section defines at least one cavity adapted to receive portions of the bow and stern sections when the watercraft is in the folded configuration;

at least one cavity is formed in at least one of the bow section and the stern section to accommodate a portion of one of the bow section and the stern section when the watercraft is in the folded configuration.

* * * * *